US009115595B2

(12) United States Patent
Snook

(10) Patent No.: US 9,115,595 B2
(45) Date of Patent: Aug. 25, 2015

(54) CLEARANCE CONTROL SYSTEM FOR A GAS TURBINE

(75) Inventor: Daniel David Snook, Opelika, AL (US)

(73) Assignee: General Electric Company, Schenectady, NY (US)

( * ) Notice: Subject to any disclaimer, the term of this patent is extended or adjusted under 35 U.S.C. 154(b) by 675 days.

(21) Appl. No.: 13/442,155

(22) Filed: Apr. 9, 2012

(65) Prior Publication Data

US 2013/0266418 A1 Oct. 10, 2013

(51) Int. Cl.
*F01D 11/24* (2006.01)

(52) U.S. Cl.
CPC ..... *F01D 11/24* (2013.01)

(58) Field of Classification Search
CPC ..... F01D 11/14; F01D 11/20; F01D 11/24
USPC ..... 415/170.1, 173.1, 173.2, 174.1, 175, 415/176, 177, 178, 180
See application file for complete search history.

(56) References Cited

U.S. PATENT DOCUMENTS

| | | | | |
|---|---|---|---|---|
| 4,513,567 | A | 4/1985 | Deveau et al. | |
| 5,351,732 | A * | 10/1994 | Mills et al. | 415/175 |
| 5,399,066 | A | 3/1995 | Ritchie et al. | |
| 6,454,529 | B1 | 9/2002 | Zearbaugh et al. | |
| 7,165,937 | B2 | 1/2007 | Doug et al. | |
| 7,293,953 | B2 | 11/2007 | Leach et al. | |
| 2006/0042266 | A1 * | 3/2006 | Albers et al. | 60/782 |
| 2007/0009349 | A1 | 1/2007 | Ward, Jr. et al. | |
| 2013/0149123 | A1 * | 6/2013 | Laurello | 415/191 |

* cited by examiner

*Primary Examiner* — Edward Look
*Assistant Examiner* — Juan G Flores
(74) *Attorney, Agent, or Firm* — Dority & Manning, P.A.

(57) ABSTRACT

A system adapted for clearance control for a gas turbine including an outer turbine casing, an inner turbine casing and a plenum defined between the inner and outer turbine casings is disclosed. The clearance control system may include an impingement box disposed within the plenum. The impingement box may define a plurality of impingement holes. In addition, the clearance control system may include a first conduit in flow communication with the interior of the impingement box and a second conduit in flow communication with the plenum at a location exterior to the impingement box.

17 Claims, 4 Drawing Sheets

FIG. –1–

CLEARANCE CONTROL SYSTEM FOR A GAS TURBINE

FIELD OF THE INVENTION

The present subject matter relates generally to gas turbines and, more particularly, to a clearance control system for a gas turbine.

BACKGROUND OF THE INVENTION

Gas turbines typically include a compressor section, a combustion section, and a turbine section. The compressor section pressurizes air flowing into the turbine. The pressurized air discharged from the compressor section flows into the combustion section, which is generally characterized by a plurality of combustors disposed in an annular array about the axis of the engine. Air entering each combustor is mixed with fuel and combusted. Hot gases of combustion flow from the combustion liner through a transition piece to the turbine section to drive the turbine and generate power. The turbine section typically includes a turbine rotor having a plurality of rotor disks and a plurality of turbine buckets extending radially outwardly from and being coupled to each rotor disk for rotation therewith. The turbine buckets are generally designed to capture and convert the kinetic energy of the hot gases of combustion flowing through the turbine section into usable rotational energy. In addition, the turbine section may also include an inner turbine casing and an outer turbine casing surrounding the inner turbine casing. As is generally understood, the inner turbine casing may be configured to encase the turbine rotor in order to contain the hot gases of combination. In doing so, a circumferential tip clearance is typically defined between the rotating buckets of the turbine rotor and an inner surface of the inner turbine casing.

During turbine operation, heat generated within the turbine results in thermal expansion of the turbine rotor and the inner turbine casing, which often causes variations in the tip clearances. For example, it may be the case that, while the turbine rotor expands consistently around its circumference, thermal expansion of the inner turbine casing may vary at different locations around its circumference (i.e., causing out-of-roundness of the casing). As a result, inadvertent rubbing may occur between the tips of the rotating buckets and the inner turbine casing, which can lead to premature failure of the buckets. Additionally, when excessive thermal expansion of inner turbine casing occurs, the tip clearances between the buckets and the inner turbine casing may become too large, thereby decreasing the overall efficiency of the gas turbine.

To facilitate optimizing turbine performance and efficiency and to minimize inadvertent rubbing between the bucket tips and the inner turbine casing, many gas turbines include active clearance control systems designed to supply a cooling fluid to the inner turbine casing, thereby promoting thermal contraction of the inner turbine casing to avoid tip rubbing. However, such clearance control systems typically require substantial pressure drops (regardless of whether the active control system is turned on or off) to facilitate cooling of the inner turbine casing. Thus, conventional clearance control systems are not as effective when the pressure drop through the system is required to be relatively low (e.g., when a gas turbine is operating at extreme temperatures and loads). Moreover, conventional clearance control systems typically require multiple air sources and are incapable of achieving deterministic heat transfer boundary conditions when the active control system is both on and off.

Accordingly, a clearance control system for gas turbines that addresses one or more of the problems identified above for conventional clearance control systems would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a system adapted for clearance control for a gas turbine including an outer turbine casing, an inner turbine casing and a plenum defined between the inner and outer turbine casings. The clearance control system may include an impingement box disposed within the plenum. The impingement box may define a plurality of impingement holes. In addition, the clearance control system may include a first conduit in flow communication with the interior of the impingement box and a second conduit in flow communication with the plenum at a location exterior to the impingement box.

In another aspect, the present subject matter is directed to a gas turbine. The gas turbine may include an outer turbine casing and an inner turbine casing spaced apart from the outer turbine casing such that a plenum is defined between the inner and outer turbine casings. In addition, the gas turbine may include an impingement box disposed between the inner and outer turbine casings. The impingement box may define a plurality of impingement holes. Moreover, the gas turbine may include a first conduit configured to supply fluid within the plenum at a location inside the impingement box and a second conduit configured to supply fluid within the plenum at a location outside the impingement box.

In a further aspect, the present subject matter is directed to a method for controlling clearances within a gas turbine including an outer turbine casing and an inner turbine casing. The method may generally include directing fluid from a pressurized fluid source through a first conduit such that the fluid flows into an impingement box disposed between the inner and outer turbine casings and re-directing the fluid through a second conduit in flow communication with a plenum defined between the inner and outer turbine casings such that the fluid flows around the exterior of the impingement box.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
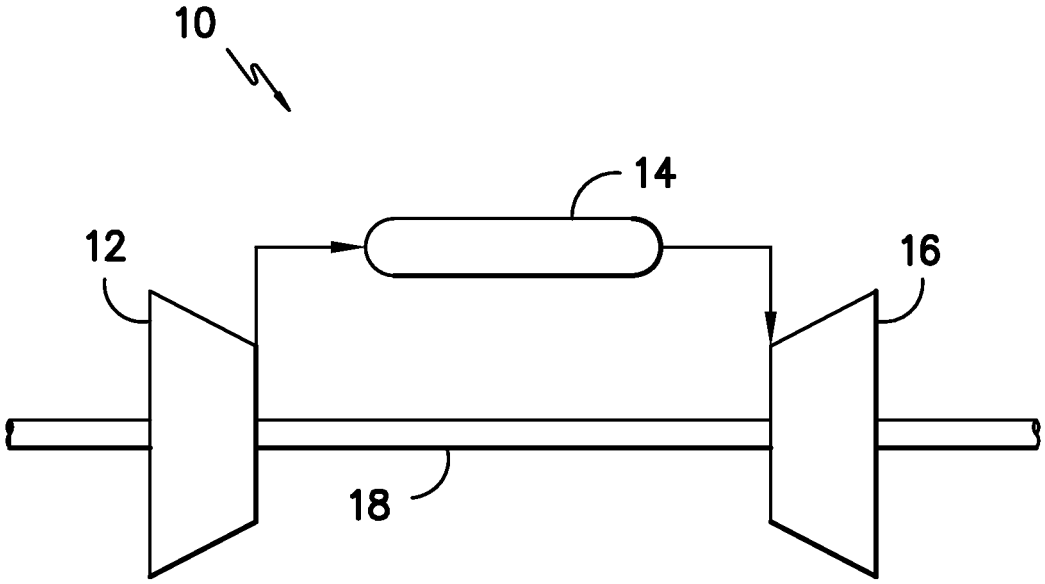
FIG. 1 illustrates a block diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a clearance control system for a gas turbine. In several embodiments, the clearance control system may include an impingement box disposed between the inner and outer turbine casings of the gas turbine. In an ON operating state, the clearance control system may be configured to supply fluid (e.g., air, steam and/or the like) into the impingement box. The fluid supplied to the impingement box may then be directed through impingement holes defined in the box and thereafter impinge directly onto the outer surface of the inner turbine casing. In an OFF operating state, the clearance control system may be configured to supply fluid to a plenum defined between the inner and outer turbine casings. The fluid supplied to the plenum may then be directed around the exterior of the impingement box and through a flow duct defined between the impingement box and the inner turbine casing.

By configuring the clearance control system as described above, numerous advantages may be provided to a gas turbine. For example, the clearance control system may provide for an increase in gas turbine efficiency by facilitating tighter tip clearances between the bucket tips and the inner turbine casing. Specifically, by supplying a cooling fluid flow to the inner turbine casing, the thermal expansion of the inner turbine casing and/or its related components may be controlled, thereby controlling the tip clearances. Additionally, by controlling the flow of fluid relative to the inner turbine casing in both the ON and OFF operating states, the clearance control system may be utilized as both an active clearance control system (in the ON state) and a passive clearance control system (in the OFF state). Moreover, in the OFF state, the clearance control system may allow for fluid to be supplied to the inner turbine casing with a very low pressure drop while still maintaining determinate heat transfer boundary conditions. Furthermore, the disclosed system may be supplied fluid from a single fluid source. For example, as will be described below, separate conduits may be configured to supply fluid to the impingement box and the plenum, with the fluid flow through the conduits being controlled by a valve coupled to a single fluid source.

Referring to the drawings, FIG. 1 illustrates a schematic depiction of one embodiment of a gas turbine 10. The gas turbine 10 includes a compressor section 12, a combustion section 14, and a turbine section 16. The combustion section 14 may include a plurality of combustors disposed around an annular array about the axis of the gas turbine 10. The compressor section 12 and turbine section 16 may be coupled by a shaft 18. The shaft 18 may be a single shaft or a plurality of shaft segments coupled together to form the shaft 18. During operation of the gas turbine 10, a compressor of the compressor section 12 (e.g., an axial flow compressor) supplies compressed air to the combustion section 14. The compressed air is mixed with fuel and burned within each combustor 20 and hot gases of combustion flow from the combustion section 14 to the turbine section 16, wherein energy is extracted from the hot gases to produce work.

Figure 2:
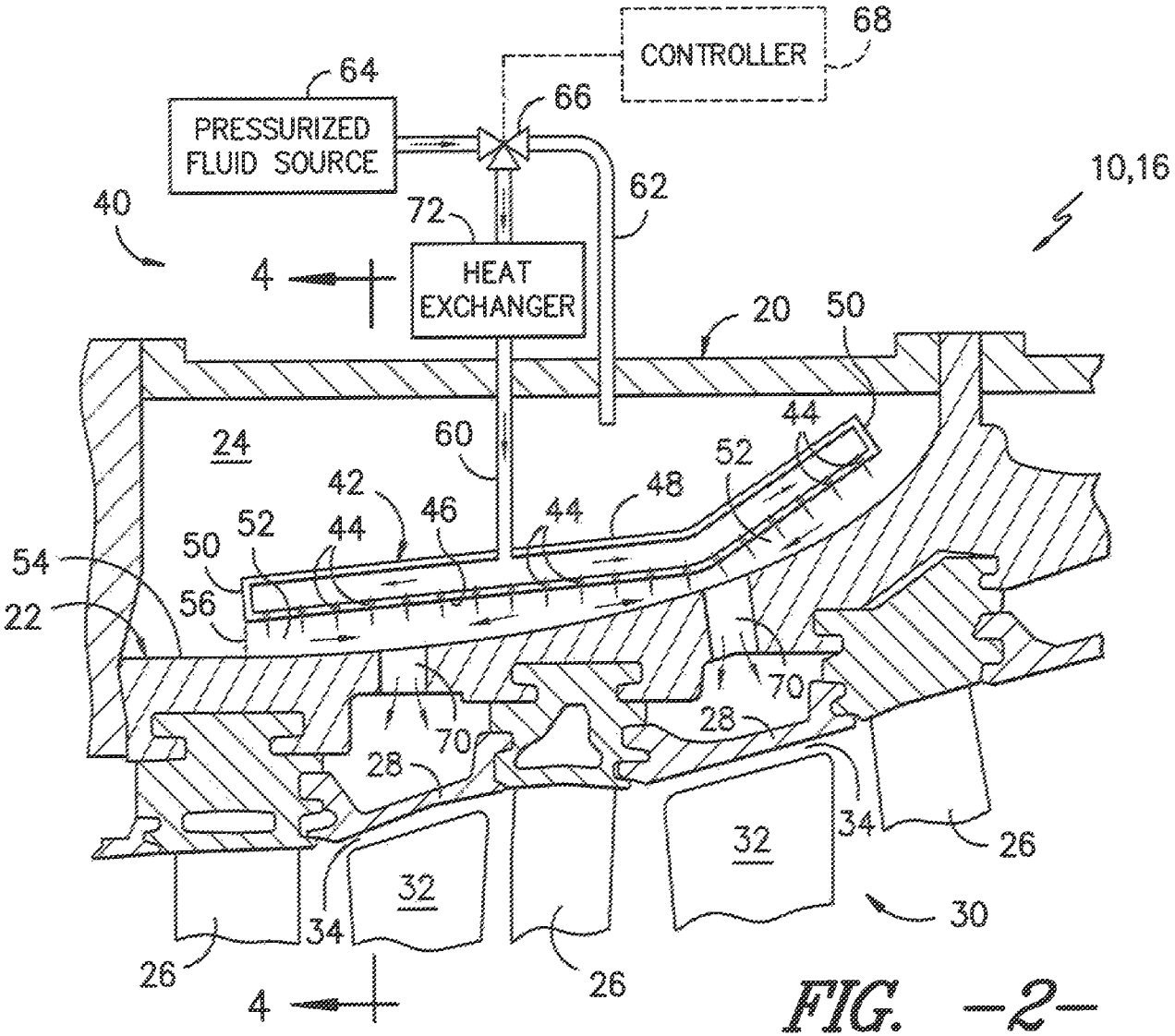
FIG. 2 illustrates a partial, cross-sectional view of one embodiment of a turbine section of a gas turbine, particularly illustrating one embodiment of a clearance control system in an ON operating state.
Figure 3:
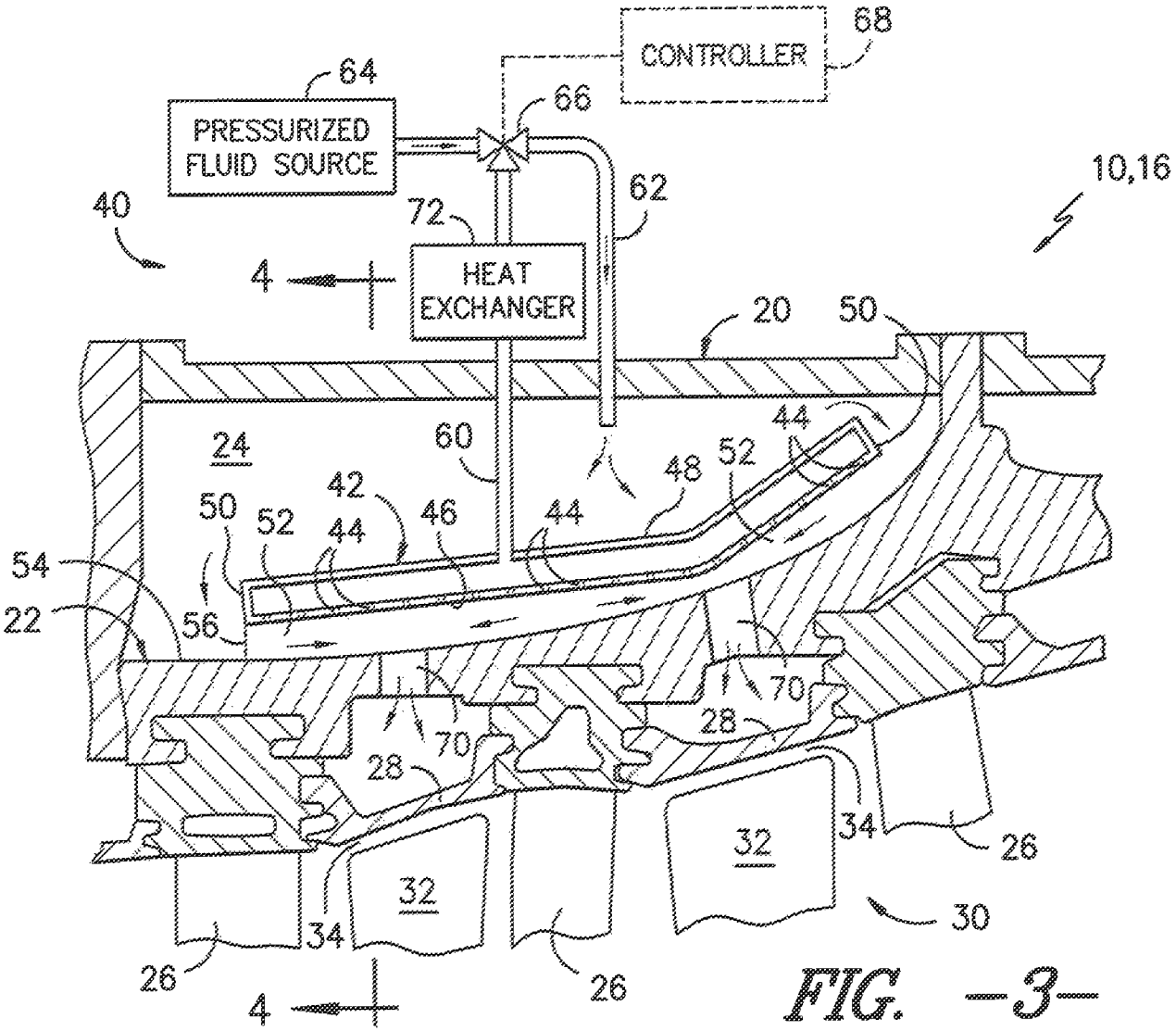
FIG. 3 illustrates a partial, cross-sectional view of one embodiment of a turbine section of a gas turbine, particularly illustrating one embodiment of a clearance control system in an OFF operating state.

Referring now to FIGS. 2 and 3, cross-sectional views of one embodiment of a portion of the turbine section 16 of a gas turbine 10 is illustrated in accordance with aspects of the present subject matter. As shown, the turbine section 16 generally includes an outer turbine casing 20 and an inner turbine casing 22. The outer turbine casing 20 may generally be configured to at least partially encase or surround the inner turbine casing 22. Thus, as shown in FIGS. 2 and 3, in several embodiments, the outer turbine casing 20 may be spaced apart radially from the inner turbine casing 22 such that a circumferential plenum 24 is defined between the inner and outer turbine casings 20, 22.

The inner turbine casing 22 may generally be configured to contain the hot gases of combustion flowing through the turbine section 16. Additionally, as shown in FIGS. 2 and 3, the inner turbine casing 22 may be configured to support a plurality of stages of stationary nozzles 26 extending radially inwardly from the inner circumference of the turbine casing 22. The inner turbine casing 22 may also be configured to support a plurality of shroud sections or blocks 28 that, when installed around the inner circumference of the inner turbine casing 22, abut one another so as to define a substantially cylindrical shape surrounding a portion of a turbine rotor 30 of the gas turbine 10. For example, as shown in FIGS. 2 and 3, each set of shroud blocks 30 supported by the inner turbine casing 22 may encase or surround one of a plurality of stages of rotating buckets 32 of the turbine rotor 30. As such, a circumferential tip clearance 34 may generally be defined between the tips of the rotating buckets 32 and the shroud blocks 28.

It should be appreciated that the outer and inner turbine casings 20, 22 shown in FIGS. 2 and 3 are provided for illustrative purposes only to place the present subject matter in an exemplary field of use. Thus, one of ordinary skill in the art should understand that the present subject matter is not limited to any particular configuration of the outer and inner turbine casings 20, 22.

Referring still to FIGS. 2 and 3, the gas turbine 10 may also include a clearance control system 40 configured supply a fluid flow (indicated by the arrows) to the inner turbine casing 22, thereby promoting thermal contraction and/or otherwise controlling the thermal growth of the inner turbine casing 22 and/or its components (e.g., the shroud blocks 28). As such, the tip clearance 34 defined between the tips of the buckets 32 and the shroud blocks 28 may be controlled in order to enhance the operating efficiency of the gas turbine 10 and to avoid inadvertent contact and/or rubbing between the buckets 32 and the shroud blocks 28.

As shown, the clearance control system 40 may include an impingement box 42 disposed within the plenum 24 defined between the outer and inner turbine casings 20, 22. In general, the impingement box 42 may comprise a walled structure having a plurality of impingement holes 44 defined in one or more of its walls. For example, as shown in the illustrated embodiment, a plurality of impingement holes 44 may be defined through an inner wall 46 of the impingement box 42. In such an embodiment, the remaining wall(s) of the impingement box 42 (e.g., an outer wall 48 and side walls 50) may be configured as a solid wall(s) such that the impingement box 42 generally defines an enclosed volume less the impingement holes 44. In other words, the interior of the impingement box 42 may be in fluid isolation from the plenum 24 except for the impingement holes 42 defined through the inner wall 46. However, it should be appreciated that, in alternatively embodiments, a plurality of impingement holes 44 may also be defined in any other wall of the impingement box 42, such as the outer wall 48 and/or one or both of the side walls 50.

Figure 4:
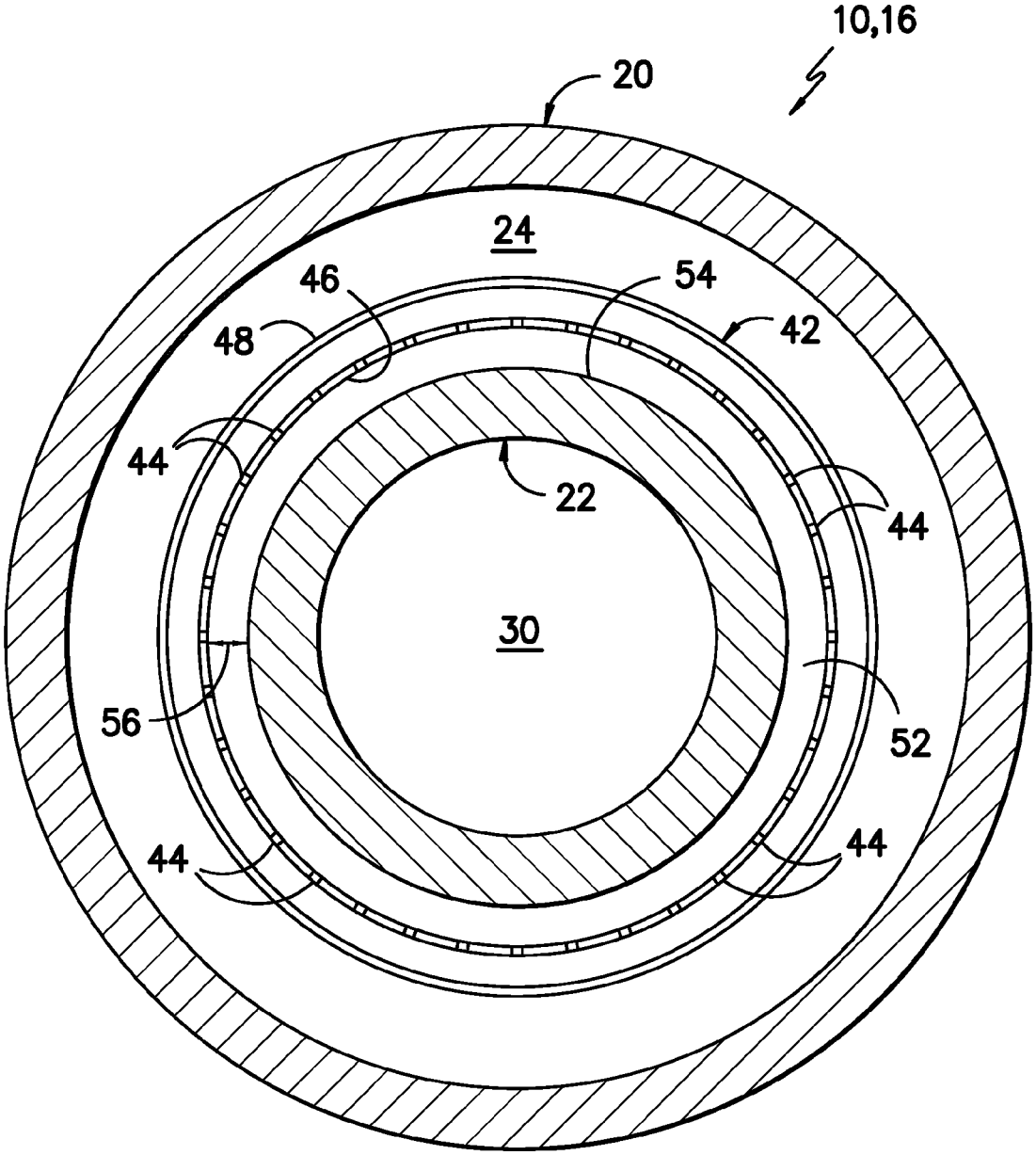
FIG. 4 illustrates a simplified, cross-sectional view of the turbine section shown in FIGS. 2 and 3 taken about line 4-4, particularly illustrating an impingement box of the clearance control system disposed between an inner turbine casing and an outer turbine casing of the gas turbine.

Additionally, in several embodiments, the impingement box 42 may be configured to at least partially surround or encase the inner turbine casing 22. For example, in several embodiments, the impingement box 22 may define an annular cross-sectional shape. Specifically, as shown in the simplified, cross-sectional view of FIG. 4, the impingement box 42 may be configured as a continuous ring such that the impingement box 42 extends around the entire outer circumference of the inner turbine casing 22. In such an embodiment, it should be appreciated that the impingement box 42 may be formed from a single component surrounding the inner turbine casing 22 or a plurality of accurate segments configured to be assembled together around the inner turbine casing 22. However, it should be appreciated that, in alternative embodiments, the impingement box 42 may be configured to extend only partially around the outer circumference of the inner turbine casing 22.

Moreover, as shown in the illustrated embodiment, the impingement box 42 may be spaced apart radially from the inner turbine casing 22 such that a circumferential flow duct 52 is defined between the inner wall 46 of the impingement box 42 and an outer surface 54 of the inner turbine casing 22. In several embodiments, the impingement box 42 may be shaped and/or otherwise configured so that a radial height 56 of the flow duct 52 remains substantially constant along an axial length 58 of the impingement box 42, such as by configuring the contour of the inner wall 46 of the impingement box 42 to generally match the contour of the outer surface 54 of the inner turbine casing 22 along the axial length 58. Alternatively, the radial height 56 of the flow duct 52 may be varied along the axial length 58 of the impingement box 42.

Referring still to FIGS. 2 and 3, the clearance control system 40 may also include one or more flow conduits 60, 62 for supplying a fluid flow to both the impingement box 42 and the plenum 24. For example, as shown in the illustrated embodiment, the system may include a first conduit 60 and a second conduit 62. In general, the first conduit 60 may be in flow communication with the impingement box 42 (e.g., by extending through both the outer turbine casing 20 and the outer wall 48 of the impingement box 42). As such, a fluid flow may be supplied through the first conduit 60 and into the interior of the impingement box 42. Similarly, the second conduit 62 may be in flow communication with the plenum 24 defined between the outer and inner turbine casings 22, 24 at a location exterior of the impingement box 42 (e.g., by extending through the outer turbine casing 20). Thus, a fluid flow may be supplied through the second conduit 62 and into the space within the plenum not occupied by the impingement box 42. It should be appreciated that, as used herein, the term "conduit" may refer to any tube, pipe, channel, passageway and/or the like through which a fluid flow may be delivered between two locations.

Additionally, in several embodiments, fluid may be supplied to the first and second conduits 60, 62 from a single, pressurized fluid source 64. For example, as shown in FIGS. 2 and 3, the first and second conduits 60, 62 may be in flow communication with the same fluid source 64 via a valve 66 coupled between the fluid source 64 and the conduits 60, 62. The valve 66 may, for instance, comprise a three-way valve having an inlet in flow communication with the fluid source 64 and two outlets in flow communication with the conduits 60, 62. In such an embodiment, the valve 66 may generally be configured to control the supply fluid to the first and second conduits 60, 62. For instance, the valve 66 may be configured to control the flow of fluid from the pressurized fluid source 64 such that the fluid is directed to either the first conduit 60 or the second conduit 62, thereby controlling whether the clearance control system 40 is operating in the ON or OFF state.

It should be appreciated that, in several embodiments, the valve 66 may be configured to automatically control the supply fluid to the first and second conduits 60, 62. For example, as shown in FIGS. 2 and 3, the valve 66 may be communicatively coupled to a turbine controller 68 of the gas turbine 10. In such an embodiment, the valve 66 may be configured to switch the flow of fluid between the first conduit 60 and the second conduit 62 based on control signals received from the controller 68.

It should also be appreciated that the pressurized fluid source 64 may generally comprise any suitable source of pressurized fluid (e.g., pressurized air, steam, water and/or the like). For instance, in one embodiment, the pressurized fluid source 64 may comprise the compressor of the gas turbine 10. Alternatively, the pressurized fluid source 64 may simply comprise a pressure vessel containing pressurized fluid. Additionally, it should be appreciated that, although the disclosed system 40 is generally described herein as including a single, pressurized fluid source 64, the system 40 may, in other embodiments, include a separate pressurized fluid source for each conduit 60, 62.

Additionally, in several embodiments, the clearance control system 40 may also include one or more heat exchangers 72 for cooling the fluid flowing from the pressurized fluid source 64. For example, as shown in FIGS. 2 and 3, a heat exchanger 64 (e.g., a water to air cooler and/or any other suitable heat exchanger) may be disposed downstream of the valve 66 and in-line with the first conduit 60 in order to cool the fluid directed through the first conduit 60. As such, the cooled fluid flowing through first conduit 60 and into the impingement box 42 may provide enhance cooling of the inner turbine casing 22 as it impinges onto the casing 22, thereby increasing the thermal contraction of the inner turbine casing 22 and minimizing the tip clearances 34 defined between the buckets 32 and the shroud blocks 28. It should be appreciated that, in alternative embodiments, a heat exchanger 72 may also be positioned in-line with the second conduit 62 in order to cool the fluid flowing through the second conduit 62 and/or a heat exchanger 72 may be disposed upstream of the valve 66 such that the fluid supplied from the pressurized fluid source 64 is cooled regardless of whether the clearance control system 40 is operating in the ON or OFF state.

By configuring the clearance control system 40 as described above, the system 40 may be utilized in both an ON operating state, wherein the system 40 operates as an active clearance control system, and an OFF operating state, wherein the system 40 operates a passive clearance control system. Specifically, in the ON operating state (FIG. 2), the valve 66 may be actuated such that a fluid flow from the pressurized fluid source 64 is directed through the first conduit 60 and into the impingement box 42. As the impingement box 42 becomes pressurized, the fluid may be directed through the impingement holes 44 and impinge onto the outer surface 54 of the inner turbine casing 22, thereby tightening the tip clearances 34 between the rotating buckets 32 and the inner turbine casing 22 as the turbine casing 22 thermally contracts. The fluid may then be directed through the flow duct 52 and into one or more cooling channels 70 defined in the inner turbine casing 22 in order to further cool the inner turbine casing 22 and/or its various components. For example, as shown in FIGS. 2 and 3, one or more cooling channels 70 may be defined in the inner turbine casing 22 such that the fluid flowing within the flow duct 52 may be directed along the radially outer surfaces of the shroud blocks 28.

Additionally, in the OFF operating state (FIG. 3), the valve 66 may be actuated such that a fluid flow from the pressurized fluid source 64 is directed through the second conduit 62 and into the plenum 24. As described above, in several embodiments, the second conduit 62 may be configured to supply fluid into the plenum 24 at a location exterior to the impingement box 42. Thus, as shown in FIG. 3, the fluid entering the plenum 24 may be directed around the exterior of the impingement box 42 and through the flow duct 52 to provide sufficient cooling around the outer circumference of the inner turbine casing 22 for maintaining determinate heat transfer boundary conditions, thereby preventing out-of-roundness of the casing 22. The fluid may then be directed through one or more cooling channels 70 defined in the inner turbine casing 22 in order to further cool the inner turbine casing 22 and/or its various components.

It should be appreciated that, in several embodiments, it may be desirable to operate the clearance control system 40 in the OFF state as the gas turbine 10 is ramping up to its steady state temperature, during a hot re-start and/or at any other time at which significant thermal contraction of the inner turbine casing 22 is not needed and/or is not desired. For example, while the gas turbine 10 is ramping up to its steady state temperature, it may be desirable to direct fluid around the impingement box 42 and through the flow duct 52 to provide sufficient cooling to maintain determinate heat transfer boundary conditions and prevent out-of-roundness of the casing 22. However, as the gas turbine 10 reaches its steady state temperature, it may be desirable to increase the amount of cooling provided to the inner turbine casing 22 in order to minimize the tip clearances 34. Thus, operation of the clearance control system 40 may be switched to the ON state such that cooled fluid is directed into the impingement box 42 and impinges onto the inner turbine casing 22, thereby causing the inner turbine casing 22 to thermally contract.

It should also be appreciated that the radial height 56 of the flow duct 52 may generally be selected such that the efficiency of the disclosed clearance control system 40 may be optimized. For example, the radial height 56 may be selected in order to provide a desired heat transfer coefficient for the fluid flowing through the flow duct 52 and to also optimize the standoff distance for impingent cooling.

Additionally, it should also be appreciated that the present subject matter is also directed to a method for controlling clearances within a gas turbine 10 including an outer turbine casing 20 and an inner turbine casing 22. In several embodiments, the method may include directing a fluid flow from a pressurized fluid source 64 through a first conduit 60 in flow communication with an impingement box 42 disposed between the outer and inner turbine casings 20, 22 and redirecting the fluid flow through a second conduit 62 in flow communication with a plenum 24 defined between the outer and inner turbine casings 20, 22 such that the fluid flow travels around the exterior of the impingement box 42.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system adapted for clearance control for a gas turbine including an outer turbine casing, an inner turbine casing and a plenum defined between the inner and outer turbine casings, the clearance control system comprising:

an impingement box disposed within the plenum, the impingement box defining a plurality of impingement holes, the impingement box being spaced radially outwardly from the inner turbine casing such that a flow duct is defined directly between the impingement box and an axial portion the inner turbine casing defined axially between opposed sidewalls of the impingement box;

a first conduit in flow communication with the interior of the impingement box; and a second conduit in flow communication with the plenum at a location exterior to the impingement box, wherein, when fluid is supplied through the second conduit and into the plenum, the fluid flows around the opposed sidewalls of the impingement box and through the flow duct defined along the axial portion of the inner turbine casing.

2. The clearance control system of claim 1, wherein fluid is supplied to the first and second conduits from a pressurized fluid source.

3. The clearance control system of claim 2, further comprising a valve in flow communication with the pressurized fluid source, the valve configured to control the supply of fluid to both the first conduit and the second conduit.

4. The clearance control system of claim 3, wherein the valve is configured to automatically switch the flow of fluid from the pressurized fluid source between the first conduit and the second conduit.

5. The clearance control system of claim 2, wherein the pressurized fluid source comprises a compressor of the gas turbine.

6. The clearance control system of claim 1, further comprising a heat exchanger configured to cool a fluid flow supplied through the first conduit.

7. The clearance control system of claim 1, wherein, when a fluid is supplied through the first conduit and into the impingement box, the fluid flows through the plurality of impingement holes and impinges onto the inner turbine casing.

8. A gas turbine, comprising:

an outer turbine casing;

an inner turbine casing spaced apart from the outer turbine casing such that a plenum is defined between the inner and outer turbine casings;

an impingement box disposed between the inner and outer turbine casings, the impingement box defining a plurality of impingement holes, the impingement box being spaced radially outwardly from the inner turbine casing such that a flow duct is defined directly between the impingement box and an axial portion the inner turbine casing defined axially between opposed sidewalls of the impingement box;

a first conduit configured to supply fluid within the plenum at a location inside the impingement box; and a second conduit configured to supply fluid within the plenum at a location outside the impingement box, wherein, when fluid is supplied through the second conduit and into the plenum, the fluid flows around the opposed sidewalls of the impingement box and through the flow duct defined along the axial portion of the inner turbine casing.

9. The gas turbine of claim 8, wherein the fluid is supplied to the first and second conduits from a pressurized fluid source.

10. The gas turbine of claim 9, further comprising a valve in flow communication with the pressurized fluid source, the valve configured to control the supply of fluid to both the first conduit and the second conduit.

11. The gas turbine of claim 10, wherein the valve is configured to automatically switch the flow of fluid from the pressurized fluid source between the first conduit and the second conduit.

12. The gas turbine of claim 9, wherein the pressurized fluid source comprises a compressor of the gas turbine.

13. The gas turbine of claim 8, further comprising a heat exchanger configured to cool a fluid flow supplied through the first conduit.

14. The gas turbine of claim 8, wherein, when fluid is supplied through the first conduit and into the impingement box, the fluid flows through the plurality of impingement holes and impinges onto the inner turbine casing.

15. A method for controlling clearances within a gas turbine, the gas turbine including an outer turbine casing and an inner turbine casing, the method comprising:

directing fluid from a pressurized fluid source through a first conduit such that the fluid flows into an impingement box disposed between the inner and outer turbine casings, the impingement box being spaced radially outwardly from the inner turbine casing such that a flow duct is defined directly between the impingement box and an axial portion the inner turbine casing defined axially between opposed sidewalls of the impingement box; and re-directing the fluid through a second conduit in flow communication with a plenum defined between the inner and outer turbine casings such that the fluid flows around the exterior of the opposed sidewalls of the impingement box and through the flow duct defined along the axial portion of the inner turbine casing.

16. The method of claim 15, further comprising cooling the fluid directed through the first conduit.

17. The method of claim 15, wherein re-directing the fluid through a second conduit in flow communication with a plenum defined between the inner and outer turbine casings such that the fluid flows around the exterior of the opposed sidewalls of the impingement box and through the flow duct defined along the axial portion of the inner turbine casing comprises altering the flow of the fluid through a valve coupled to the first and second conduits.

* * * * *